US005680672A

United States Patent [19]

Baumann

[11] Patent Number: 5,680,672

[45] Date of Patent: Oct. 28, 1997

[54] DUST REMOVING FAN SYSTEM FOR CIRCULAR KNITTING MACHINES

[75] Inventor: John Baumann, Islip, N.Y.

[73] Assignee: Uniwave, Inc., Farmingdale, N.Y.

[21] Appl. No.: 725,334

[22] Filed: Oct. 1, 1996

[51] Int. Cl.[6] ..... A47L 5/38; A47L 5/00; D04B 35/32

[52] U.S. Cl. ..... 15/312.1; 15/301; 15/316.1; 66/168

[58] Field of Search ..... 15/301, 312.1, 15/316.1; 66/168

[56] References Cited

U.S. PATENT DOCUMENTS

| | | | |
|---|---|---|---|
| Re. 15,705 | 10/1923 | Glasse . | |
| 1,332,875 | 3/1920 | Ainsworth . | |
| 1,939,481 | 12/1933 | Albers | 230/254 |
| 2,976,557 | 3/1961 | King, Jr. | 15/312 |
| 2,994,904 | 8/1961 | Allred | 15/312.1 |
| 3,072,321 | 1/1963 | King, Jr. | 230/255 |
| 3,375,539 | 4/1968 | Loepsinger | 15/312 |
| 5,175,905 | 1/1993 | Gutschmit | 15/312.1 |
| 5,195,337 | 3/1993 | Gutschmit | 66/168 |
| 5,417,090 | 5/1995 | Baumann | 66/168 |
| 5,469,718 | 11/1995 | Gutschmit | 66/168 |
| 5,507,841 | 4/1996 | Heckman et al. | 15/312.1 X |

FOREIGN PATENT DOCUMENTS 685429 1/1953 United Kingdom .

*Primary Examiner*—John J. Calvert
*Attorney, Agent, or Firm*—Schweitzer Cornman Gross & Bondell LLP

[57] ABSTRACT

A fan blower apparatus for use in connection with circular knitting machines includes a relatively small diameter frame to which a drive motor is mounted. The drive motor rotates an L-shaped platform about a vertical axis. The platform supports a fan unit journaled for rotation about a vertical axis. A belt system utilizes the rotation of the platform about the vertical axis to provide a drive motor to rotate the fan unit about the horizontal axis. An integral air spray system may be incorporated into the frame to provide a cleansing air spray for the fan unit as it operates.

6 Claims, 3 Drawing Sheets

DUST REMOVING FAN SYSTEM FOR CIRCULAR KNITTING MACHINES

BACKGROUND OF THE INVENTION

The present invention relates to the textile arts and, in particular, to a new and improved apparatus adapted to provide for the removal of lint, dust and other unwanted materials from a circular knitting machine by the application of a directed stream of air over the knitting machine surfaces.

It is well known and recognized that the processing of textile fibers, including the knitting thereof into fabric, generates large quantities of fiber, lint and other debris. This debris often permeates the environment in which the processing equipment is located, and settles on the exposed surfaces of the equipment. The continued accumulation of the debris, especially on the active machinery elements, can result in unsatisfactory operation, and possible ultimate machinery failure. In addition, the debris can be trapped in the produced fabric, creating defects therein.

Debris accumulation and contamination is a significant problem in circular knitting machines which, because of their size and operating speed, can generate a large amount of lint and other debris. Such machines may have a substantial diameter, utilizing a large number of reciprocating needles and associated devices, including yarn feeds and linkages needed to synchronize the knitting process. Associated with such operation is the generation of an often prodigious amount of lint and other debris.

In order to limit the amount of such debris accumulating on the equipment, and to remove the debris therefrom, a variety of fan-type apparatus have been developed, as exemplified by the units shown in U.S. Pat. No. 5,417,090 to the present inventor and as set forth in U.S. Pat. No. 5,195,337 to A. Gutschmidt. In general, such fan cleaning devices utilize a centrally-mounted arm, journaled for rotation about the central mount. An oscillating or rotating fan assembly is mounted at the distal end of the arm. The combined motion provided by the motion of the fan assembly in combination with rotation of the arm directs a flow of air over various portions of the knitting machine.

Fans of the aforementioned type may be used advantageously with circular knitting machines having a diameter sufficient to accommodate placement of the fan within the knitting machine and to accept the rotation of a fan arm therein. Certain circular knitting machines, however, particularly those utilized in the manufacture of small diameter tubular fabrics, such as may be used, for example, for pantyhose fabric, do not provide a sufficient interior diameter capable of accommodating such fan units. In addition, fan cleaner apparatus of the aforementioned type typically require three independent motors for operation: a first motor to rotate the fan arm; a second motor to rotate or oscillate the fan assembly at the end of arm; and a third motor to drive the fan blades. Such requirements can add to the costs and size of the resulting unit, and have in the past hindered the development and utilization of such type constructions in connection with small size knitting machines.

BRIEF SUMMARY OF THE INVENTION

It is accordingly a purpose of the present invention to provide a fan-based cleaning apparatus particularly adapted for utilization in conjunction with circular knitting machines, and especially circular knitting machines which would otherwise not have the dimensions suitable for use of fan-based cleaning apparatus having a rotating arm.

It is a further purpose of the present invention to provide a knitting machine cleaning apparatus in which multiple rotational movements can be developed through a single drive motor to allow an apparatus of particularly compact shape to be created.

Yet a further purpose of the present invention is to provide a fan-based knitting machine apparatus which can include means for cleaning the fan blades of debris which otherwise may collect thereon, inhibiting effective operation of the fan apparatus.

In accordance with the foregoing and other objects, a fan system embodying the present invention comprises a fan platform mounted for rotation within a frame about a vertical axis by means of a drive motor. The platform includes an upright portion which support a fan blower assembly comprising a fan and a fan drive motor mounted in a cradle. The cradle is supported by the upright portion for rotation about a horizontal axis. A drive system is provided to rotate the fan assembly about the horizontal axis simultaneously with, and as a result of, the fan platform rotating about the first vertical axis by operation of the drive motor. The drive system may comprise a belt driving a shaft which defines the horizontal axis, the belt being in frictional contact with a fixed track on the motor platform.

An air spray system may be provided to allow lint and other debris accumulating on the fan unit to be removed. A series of air jets are provided along a portion of the frame, and are connected to a source of compressed air. The compressed air exiting from the jets impinges on the fan unit as it rotates about the horizontal axis, dislodging lint and debris therefrom.

BRIEF DESCRIPTION OF THE DRAWINGS

A fuller understanding of the present invention and the features and benefits thereof may be accomplished upon consideration of the following detailed description of the preferred, but nonetheless illustrative embodiment of the invention, when considered in connection with the annexed drawings, wherein.

DETAILED DESCRIPTION OF THE INVENTION

Figure 1:
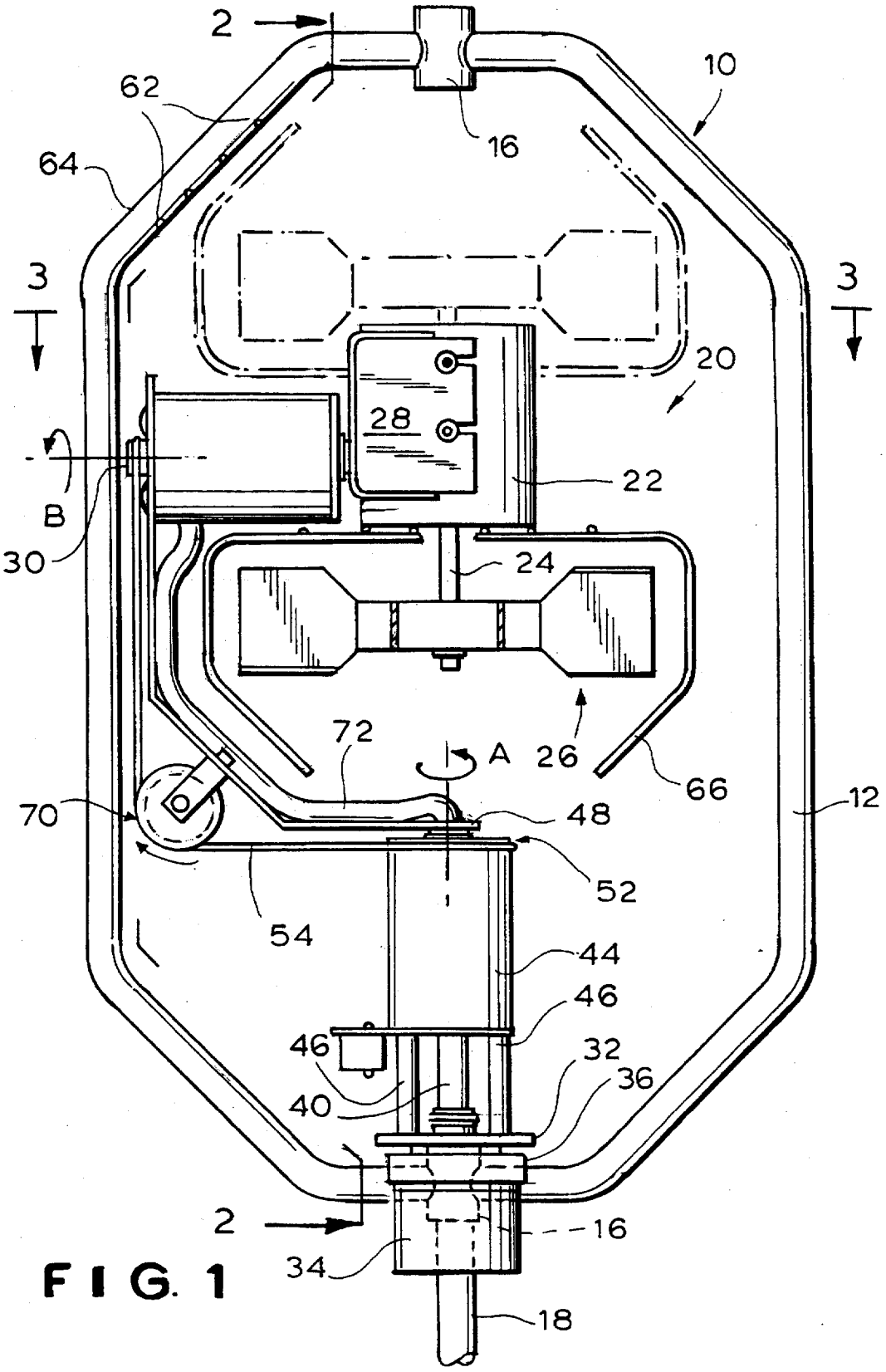
FIG. 1 is a first elevation view of the present invention.

With reference to the Figures and particularly FIG. 1 thereof, a fan apparatus 10 constructed in accordance with the present invention comprises a tubular outer frame 12 which may include a pair of formed tubing sections 14 joined at their upper and lower ends by connectors 16. The lower connector 16 is adapted to accept a post 18, the lower end of which (not shown) is mounted into a floor stand or base to support the fan apparatus during operation. The upper connector 16 may analogously accept a depending post (not shown) when it is desired to mount and suspend the fan apparatus from above. The frame 12 provides a cage for the apparatus, the distance between the opposed vertical portions of the tubing sections 14 defining the minimum diameter knitting machine interior into which the apparatus can be placed.

Fan unit 20, comprising fan motor 22 having shaft 24 to which fan blade assembly 26 is mounted and cradle 28, is mounted to generally L-shaped platform 48 by shaft 30 which is affixed to the cradle 28 and journaled within commutator 50 mounted to the leg of platform 48 to allow rotation of the fan unit in a vertical plane as defined by the horizontal axis of shaft 30 and as depicted by the rotation arrow "B". The fan blade assembly 26 may be surrounded by a fan guard 66.

Figure 2:
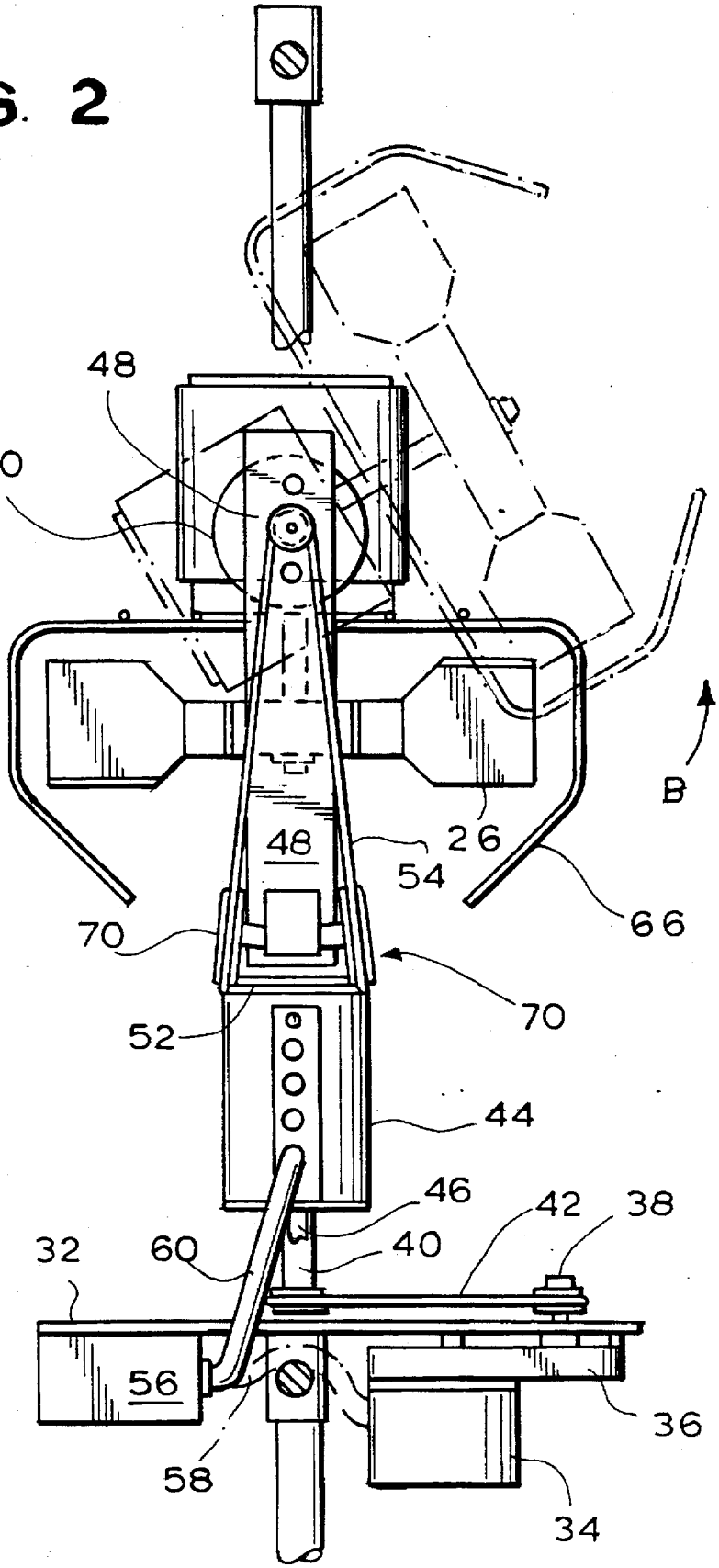
FIG. 2 is a side elevation view of the invention taken along line 2—2 of FIG. 1.
Figure 3:
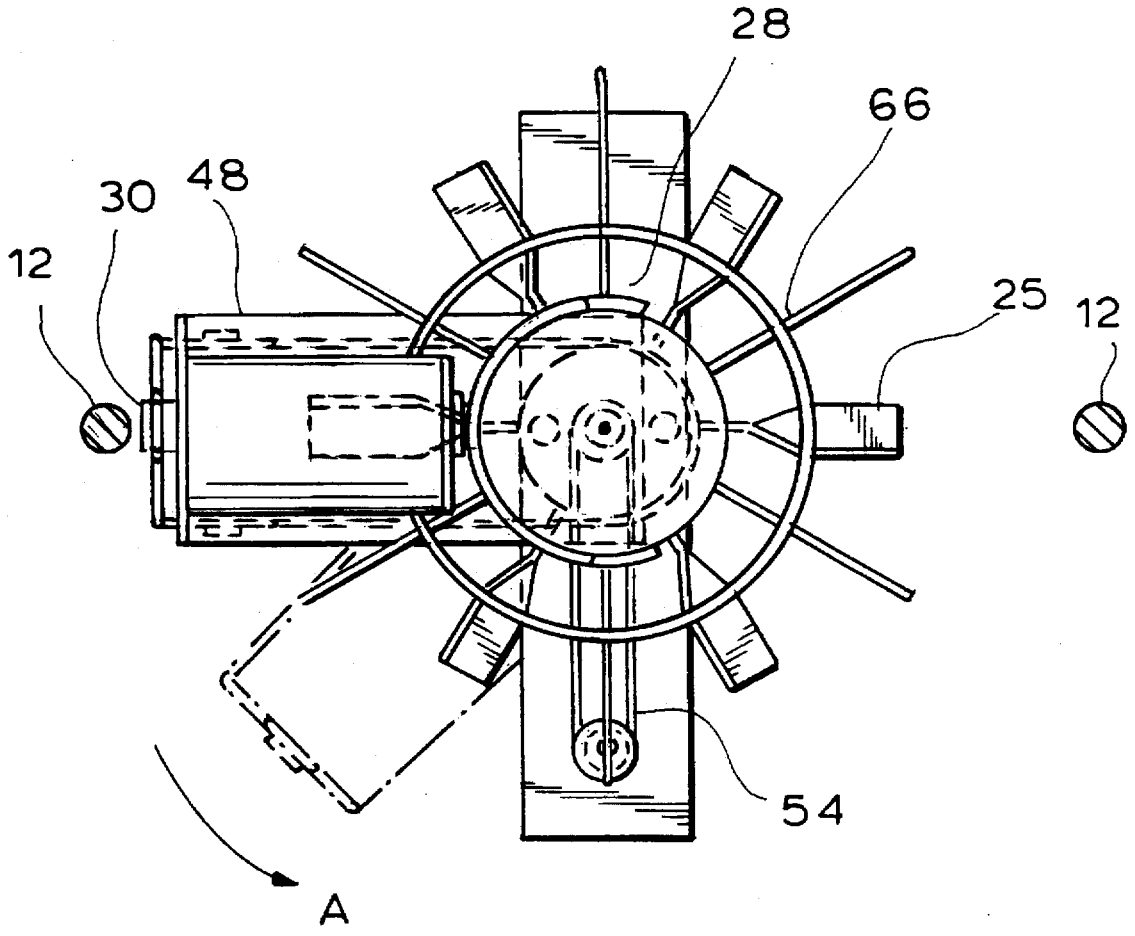
FIG. 3 is a top plan view of the invention as seen in section along line 3—3 in FIG. 1.

A table 32, perhaps best seen in FIG. 2, is affixed to the lower portion of the frame 12 and supports main drive motor 34 and associated gear assembly 36. The output shaft 38 of the gear assembly is coupled to main vertical shaft 40 by drive belt 42. The vertical shaft 40 is journaled within commutator 44, the housing of which is rigidly mounted to the table 32 by legs 46. The L-shaped platform 48 is mounted to the upper end of vertical shaft 40. Operation of drive motor 34 thus causes rotation of the platform 48, and the attached fan unit 20, about the vertical axis defined by shaft 40 as depicted by rotation "A". The fan unit is mounted to the table such that the axis for fan motor shaft 24, when vertical, coincides with the axis of shaft 40. Such an arrangement provides for a compact design and elimination of unbalanced torques during operation.

In contradistinction to prior fan blower systems which have required an independent drive to rotate a fan unit in second direction "B", the present invention includes a drive system coupling the shaft 30 to drive motor 34. In particular, the cylindrical housing of commutator 44 may be provided with an integral circumferential track or groove 52 proximate its upper end as seen in FIGS. 1 and 2. A drive belt 54 engages the track 52, is supported by idler pulleys 70 mounted to an intermediate portion of platform 48, and continues upwardly to engage the shaft 30, which may be provided with an appropriate belt track or groove. Even though commutator 44 and thus its belt track 52 is stationary, the rotation of the platform 48 about the axis of main vertical shaft 40 provides relative motion between the belt and the housing, causing the belt to continuously frictionally engage and "wrap" about the commutator track during such rotation. This continuous engagement results in belt motion, driving the shaft 30 and resulting in rotation of the fan unit 20 about the horizontal axis of shaft 30. Thus, operation of drive motor 34 both rotates platform 48 and fan unit 20 about the vertical axis of shaft 40 while simultaneously providing for rotation of the fan unit 20 about the horizontal axis of shaft 30.

As best seen in FIG. 2, electric power is provided to the apparatus from main power box 56 mounted to table 32. Power box 56 is connected to a source of mains power as known in the art. A first cable 58 passes from the box to drive motor 34, providing power to the motor, while a second cable 60 leads to commutator 44. A rotating electric connection provided by commutator 44 as known in the art allows power to be passed through third cable 72, seen in FIG. 1, which preferably may extend through vertical shaft 40, which is hollow, along platform 48 to second commutator 50, the rotating contacts of which allow the power to be passed to fan motor 22 through an appropriate cable in hollow shaft 30 (not shown).

The present invention may further provide for integral means for cleaning the fan unit during operation. A series of small diameter bores 62 may be provided in a portion of the frame, such as in an upper angular portion 64 of a frame tubing member 14. One of the couplings 16 can provide a connecting passageway between the interiors of the tubing members 14 and, for example, upright 18, allowing compressed air to be directed into the upright and thus into the tubing members for exit as a cleansing spray through the bores 62. As the fan unit rotates in direction "B" it passes proximate the bores, allowing lint and debris which may have accumulated upon the fan blades, the fan guard 66, and associated elements to be driven off. The source of compressed air (not shown) may provide air on a varying, timed, or pulsed cycle as may be desired. The unused coupling 16 may be capped or closed as necessary to provide a closed air supply.

The present invention allows an extremely compact fan system to be employed in connection with circular knitting machines and like apparatus having a relatively small working space for a cleaning unit. The maximum diameter of the apparatus, which may be defined as the diameter defined by the parallel vertical sides of the frame tubing 14, may be on a scale of 14 inches, with an overall height from upper to lower coupling 16 of approximately 23 inches. The output speed of gear output shaft 38 may be 2.14 rpm with the relationship between the diameter of commutator belt track 52 and shaft 30 providing a rotation speed for shaft 30 of approximately 7.7 rpm. Such relationship allows for approximately 3.6 revolutions in direction "B" per rotation in direction "A". The air wash formed by the rotation of the fan blade assembly 26 thus both sweeps horizontally about the interior of the circular knitting machine, as well as vertically, thus providing for a cumulative cleaning effect over the entire inner periphery of the knitting machine.

I claim:

1. A fan blower for use in connection with circular knitting machines comprising:

a frame;

a first drive motor mounted to said frame and having a vertically-extending output shaft;

an L-shaped platform coupled to said shaft for rotation within said frame about a vertical axis;

a fan unit comprising a fan motor, a fan mounted to an output shaft of said fan motor and a mounting cradle for said motor, said fan unit being mounted to said L-shaped platform for rotation about a horizontal shaft extending perpendicular to said fan motor shaft;

a first horizontally-disposed, fixed belt track mounted to said frame;

a second belt track mounted to said horizontal shaft; and belt means between said first and second belt tracks to rotate said fan motor about said horizontal shaft as a result of said first drive motor rotating said L-shaped platform about said vertical axis.

2. The fan blower of claim 1 further comprising first commutator means between said frame and L-shaped platform and second commutator means between said L-shaped platform and said fan unit to transmit electrical power to said fan motor during rotation of said L-shaped platform and fan unit.

3. The fan blower of claim 2, wherein said first commutator means includes a fixed housing mounted to said frame, said first belt track being located on said housing.

4. The fan blower of claim 1, wherein said frame includes a pair of tubular members having vertical side portions, said L-shaped platform being located between said side portions.

5. The fan blower of claim 4 further comprising air spray means mounted to said frame for directing a cleansing compressed air spray towards said fan unit.

6. The fan blower of claim 5, wherein said spray means comprise spray bores in a portion of at least one of said tubular members.

* * * * *